US005812918A

United States Patent [19]

Nakaue et al.

[11] Patent Number: 5,812,918

[45] Date of Patent: Sep. 22, 1998

[54] ELECTROSTATIC LATENT IMAGE DEVELOPING DEVICE WITH DEVELOPING AGENT-LIMITING MEANS

[75] Inventors: Takahisa Nakaue; Masanobu Maeshima; Akinobu Nakahata; Takeshi Aoki; Hiroshi Inui, all of Osaka, Japan

[73] Assignee: Mita Industrial Co., Ltd., Osaka, Japan

[21] Appl. No.: 739,571

[22] Filed: Oct. 30, 1996

[30] Foreign Application Priority Data

| | | | |
|---|---|---|---|
| Nov. 10, 1995 | [JP] | Japan | 7-317178 |
| Nov. 10, 1995 | [JP] | Japan | 7-317179 |
| Nov. 10, 1995 | [JP] | Japan | 7-317182 |
| Nov. 10, 1995 | [JP] | Japan | 7-317183 |
| Nov. 10, 1995 | [JP] | Japan | 7-317184 |
| Nov. 10, 1995 | [JP] | Japan | 7-317185 |
| Nov. 10, 1995 | [JP] | Japan | 7-317187 |

[51] Int. Cl.[6] ..... G03G 15/08

[52] U.S. Cl. ..... 399/284; 399/279; 399/281

[58] Field of Search ..... 399/260, 264, 399/273, 274, 283, 281, 284, 279

[56] References Cited

U.S. PATENT DOCUMENTS

| | | | |
|---|---|---|---|
| 4,286,543 | 9/1981 | Ohnuma et al. | 399/274 |
| 5,220,129 | 6/1993 | Nishio et al. | 399/284 |
| 5,412,458 | 5/1995 | Kamaji et al. | 399/284 X |
| 5,424,817 | 6/1995 | Imamiya et al. | 399/283 X |
| 5,557,060 | 9/1996 | Okada et al. | 399/284 X |

*Primary Examiner*—Shuk Lee

*Attorney, Agent, or Firm*—Beveridge, DeGrandi, Weilacher & Young, LLP

[57] ABSTRACT

A device for developing an electrostatic latent image includes a developing roller disposed in a developing housing and a developing agent-limiting device for limiting the amount of the developing agent held on the peripheral surface of the developing roller. The developing agent-limiting device includes a flexible blade brought into pressed contact with the peripheral surface of the developing roller, a flexible support plate that is mounted on the blade and supports the blade in a predetermined positional relationship with respect to the developing roller, and a resilient urging device that is constituted by a plurality of spring members arranged on the back surface of the support plate at a distance in the direction of width thereof and pushes the blade in a direction in which it comes into pressed contact with the peripheral surface of the developing roller via the support plate.

12 Claims, 8 Drawing Sheets

ELECTROSTATIC LATENT IMAGE DEVELOPING DEVICE WITH DEVELOPING AGENT-LIMITING MEANS

FIELD OF THE INVENTION

The present invention relates to a device for developing electrostatic latent image used for developing electrostatic latent image into toner image in an image-forming machine such as electrostatic copying machine or laser printer. More specifically, the invention relates to a device for developing electrostatic latent image of the type equipped with a developing roller which holds the developing agent on the peripheral surface thereof to convey it to a developing zone and a developing agent-limiting means which acts on the peripheral surface of the developing roller to limit the amount of the developing agent held on the peripheral surface thereof.

DESCRIPTION OF THE PRIOR ART

As is well known, a device for developing electrostatic latent image of the type equipped with a developing roller which is rotated in a predetermined direction has been put into wide practical use in the image-forming machines in order to develop electrostatic latent image into toner image. The developing roller is rotated in a predetermined direction so as to travel through a developing agent-holding zone, a developing agent-limiting zone and a developing zone, successively. In the developing agent-holding zone, the toner which is the developing agent fed by a suitable system is held on the peripheral surface of the developing roller. In the developing agent-limiting zone, the developing agent-limiting means acts on the toner which is the developing agent held on the peripheral surface of the developing roller to limit the amount of the toner held on the peripheral surface of the developing roller to a required amount. In the developing zone, the toner which is the developing agent is applied to the peripheral surface of an electrostatic latent image carrier such as a rotary drum, which has an electrostatic photosensitive layer on the peripheral surface thereof, and electrostatic latent image formed on the surface of the electrostatic latent image carrier is developed into toner image. To accomplish good developing, it is important to suitably limit the amount of the toner held on the peripheral surface of the developing roller by the developing agent-limiting means and to form a toner layer on the peripheral surface of the developing roller in a predetermined thickness and sufficiently uniformly in the axial direction.

Japanese Patent Publication No. 16736/1988 discloses a device for developing electrostatic latent image equipped with a limiting means having a blade which is made of a rubbery elastic material composed of a synthetic rubber such as urethane rubber, silicone rubber or the like. The rubbery elastic material constituting the developing agent-limiting means is brought, at its one surface or front edge, into pressed contact with the peripheral surface of the developing roller, limits the amount of the toner held on the peripheral surface of the developing roller to a considerably small amount thereby to form a thin toner layer on the peripheral surface of the developing roller. Furthermore, the device having the developing agent-limiting means constituted by the blade made of a thin spring stainless steel plate having a thickness of 0.1 to 0.2 mm has been put into practical use. In the developing agent-limiting means using an elastic blade made of a rubbery elastic material or a thin stainless steel plate, however, the rigidity becomes low at both ends of the elastic blade and the limiting force at the both ends becomes smaller than that at the central portion. Therefore, the toner layer formed on the peripheral surface of the developing roller becomes thicker toward both ends than at the central portion. Experiment conducted by the present inventors teaches that when a urethane blade is used, the toner layer at both ends becomes thicker than the central portion by 3.5 to 7.0 $\mu$m. When the elastic blade is used, as described above, it is difficult to form the toner layer on the peripheral surface of the developing roller in a uniform thickness over the whole width in the axial direction and in consequence, a uniform image is not obtained. Besides, the elastic blade has an abrasion resistance which is not so high, and hence, is not necessarily satisfactory from the standpoint of life.

In order to solve the above-mentioned problems of the elastic blade, there has been proposed an invention in which the blade constituting the developing agent-limiting means is made of a rigid member such as glass or the like (Japanese Laid-Open Patent Publication No. 36277/1995). By forming the blade using a sheet glass which is a rigid material, it is made possible to uniformly limit the thickness of the toner layer formed on the peripheral surface of the developing roller in the direction of width thereby to improve abrasion resistance and to lengthen the life to a satisfactory degree.

In the case where the blade made of a rigid member is used to constitute the developing agent-limiting means that limits the amount of the developing agent held on the surface of the developing roller, however, if the developing roller and the blade become out of parallel due to deviation of the shaft of the developing roller caused by production error or due to warping of the developing housing, the contacting force of the blade does not become uniform in the direction of the width, and it becomes no longer possible to uniformalize the thickness of the toner layer formed on the peripheral surface of the developing roller over the whole width in the axial direction.

Further, in the case where the blade made of a rigid member such as a sheet glass is used to constitute the developing agent-limiting means that limits the amount of the developing agent held on the peripheral surface of the developing roller, if the developing roller and the blade become out of parallel due to deviation of the shaft of the developing roller caused by production error or due to warping of the developing housing, the contacting force of the blade does not become uniform in the direction of the width, and it becomes no longer possible to uniformalize the thickness of the toner layer formed on the peripheral surface of the developing roller over the whole width in the axial direction.

It was also learned through experiments conducted by the present inventors that the thickness and stability of the toner layer formed on the peripheral surface of the developing roller are greatly affected by the amount of projection of the blade constituting the developing agent-limiting means from the center of contact with the peripheral surface of the developing roller to the lower end of the blade. That is, when the amount of projection is smaller than a predetermined range, the thickness of the developing agent layer formed on the peripheral surface of the developing roller tends to become extremely small. When the amount of projection is larger than the predetermined range, on the other hand, the thickness of the developing agent layer formed on the peripheral surface of the developing roller becomes extremely large.

It was also learned through experiments conducted by the present inventors that the thickness and stability of the toner layer formed on the peripheral surface of the developing roller are greatly affected by the contacting force of the blade constituting the developing agent-limiting means, exerted on the peripheral surface of the developing roller. That is, when the contacting force is larger than a predetermined range, the thickness of the developing agent layer formed on the peripheral surface of the developing roller tends to become very small. When the contacting force is smaller than the predetermined range, on the other hand, the thickness of the developing agent layer formed on the peripheral surface of the developing roller becomes very large.

Furthermore, it was learned through experiments conducted by the present inventors that the thickness and stability of the toner layer formed on the peripheral surface of the developing roller are greatly affected by the roughness of the peripheral surface of the developing roller. That is, when the roughness of the peripheral surface of the developing roller is smaller than a predetermined range, the thickness of the developing agent layer formed on the peripheral surface of the developing roller tends to become very small. When the surface roughness is larger than the predetermined range, on the other hand, the thickness of the developing agent layer formed on the peripheral surface of the developing roller becomes very large.

It was also learned through experiments conducted by the present inventors that setting of the developing roller having a suitable hardness plays an important role for forming the toner layer in a predetermined thickness on the peripheral surface of the developing roller. Experiment teaches that the thickness of the toner layer formed on the peripheral surface of the developing roller decreases with a decrease in the hardness of the developing roller, and the thickness of the toner layer formed on the peripheral surface of the roller increases with an increase in the hardness of the developing roller. Moreover, the thickness of the toner layer formed on the peripheral surface of the developing roller varies depending upon the contacting force of the blade constituting the developing agent-limiting means, which acts on the peripheral surface of the developing roller; i.e., the thickness of the toner layer formed on the peripheral surface of the developing roller increases with a decrease in the contacting force, and the thickness of the toner layer formed on the peripheral surface of the developing roller decreases with an increase in the contacting force. It was further learned that the uniform toner layer can not be obtained stably and variation in thickness of the toner layer frequently occurs when the contacting force is too small or is too large. It is known that the quality of image greatly varies depending upon the thickness of the toner layer formed on the surface of the developing roller. When the thickness of the toner layer is smaller than, for example, 20 $\mu$m, the image density becomes so low that a copied image loses vividness. When the thickness of the toner layer becomes larger than, for example, 30 $\mu$m, a so-called image base fogging occurs in which toner adheres to the areas other than the image areas. The developing roller is generally constituted by a rotary shaft made of a metal material and a rubber roller fitted onto the rotary shaft. Therefore, it was learned through experiments conducted by the present inventors that the substantial hardness of the developing roller as an assembly varies depending upon the thickness of the rubber roller fitted onto the rotary shaft and the thickness and stability of the toner layer formed on the peripheral surface of the developing roller are greatly affected by the substantial hardness of the developing roller.

It was further learned through experiment conducted by the present inventors that even the toner layer formed in a predetermined thickness on the peripheral surface of the developing roller through limitation made by the blade undergoes a change in the density, i.e., undergoes a change in the amount of the developing agent conveyed to the developing zone depending upon the amount of the developing agent fed onto the peripheral surface of the developing roller by the replenishing roller in the developing agent-holding zone. It was further learned that the density of the developing agent layer formed on the peripheral surface of the developing roller varies even depending upon the thickness of the blade itself. The density of the image decreases with a decrease in the amount of the developing agent that is conveyed to the developing zone being held on the peripheral surface of the developing roller, whereas the so-called fogging phenomenon takes place when the developing agent is conveyed in too large amounts.

SUMMARY OF THE INVENTION

A first object of the present invention is to provide a device for developing electrostatic latent image in which the contacting force of the blade on the developing roller is uniformalized in the direction of the whole width, and the thickness of the toner layer formed on the peripheral surface of the developing roller is uniformalized over the whole width in the axial direction even though the developing roller and the blade become out of parallel due to deviation of the shaft of the developing roller.

A second object of the present invention is to provide a device for developing electrostatic latent image in which the contacting force of the glass blade on the developing roller is uniformalized in the direction of the whole width, and the thickness of the toner layer formed on the surface of the developing roller is uniformalized over the whole width in the axial direction even though the developing roller and the glass blade become out of parallel due to deviation of the shaft of the developing roller.

A third object of the present invention is to provide a device for developing electrostatic latent image which is capable of stably forming a developing agent layer in a thickness within a predetermined range on the peripheral surface of the developing roller by setting the amount of projection of the blade constituting the developing agent-limiting means from the center of contact with the peripheral surface of the developing roller to the lower end of the blade within a predetermined range.

A fourth object of the present invention is to provide a device for developing electrostatic latent image which is capable of stably forming a developing agent layer in a thickness within a predetermined range on the peripheral surface of the developing roller by setting the contacting force of the blade constituting the developing agent-limiting means exerted on the peripheral surface of the developing roller within a predetermined range.

A fifth object of the present invention is to provide a device for developing electrostatic latent image which is capable of stably forming a developing agent layer in a thickness within a predetermined range on the peripheral surface of the developing roller by setting the roughness of the peripheral surface of the developing roller within a predetermined range.

A sixth object of the present invention is to provide a device for developing electrostatic latent image which is capable of stably forming a developing agent layer in a thickness within a predetermined range on the peripheral surface of the developing roller by setting the substantial hardness of the developing roller within a predetermined range, the developing roller being constituted by a rotary shaft formed of a metal material and a solid synthetic rubber roller fitted onto the rotary shaft.

A seventh object of the present invention is to provide a device for developing electrostatic latent image which is capable of setting the conveyance amount of the developing agent held on the peripheral surface of the developing roller within a predetermined range by setting the thickness of the blade constituting the developing agent-limiting means and the nipping width in which the developing roller and the replenishing roller are in contact with each other within predetermined ranges.

In order to accomplish the above-mentioned first object, the present invention provides a device for developing electrostatic latent image comprising a developing housing, a developing roller disposed in the developing housing to hold, on the peripheral surface thereof, a developing agent in a developing agent-holding zone and convey the thus held developing agent to a developing zone to apply it to the electrostatic latent image, and a developing agent-limiting means for limiting the amount of the developing agent held on the peripheral surface of the developing roller in a developing agent-limiting zone positioned between the developing agent-holding zone and the developing zone, wherein the developing agent-limiting means includes a flexible blade of which the one surface is brought into pressed contact with the peripheral surface of the developing roller, a flexible support plate which is mounted on the other surface of the blade and supports the blade maintaining a predetermined positional relationship with respect to the developing roller, and a resilient urging means which is constituted by a plurality of spring members arranged on the back surface of the support plate at a distance in the direction of width thereof and pushes the blade in a direction in which it comes into pressed contact with the peripheral surface of the developing roller via the support plate.

Furthermore, in order to accomplish the above-mentioned first object, the present invention provides a device for developing electrostatic latent image comprising a developing housing, a developing roller disposed in the developing housing to hold, on the peripheral surface thereof, a developing agent in a developing agent-holding zone and convey the thus held developing agent to a developing zone to apply it to the electrostatic latent image, and a developing agent-limiting means for limiting the amount of the developing agent held on the peripheral surface of the developing roller in a developing agent-limiting zone positioned between the developing agent-holding zone and the developing zone, wherein the developing agent-limiting means includes a flexible blade of which the one surface is brought into pressed contact with the peripheral surface of the developing roller, a flexible support plate which is mounted on the other surface of the blade and supports the blade maintaining a predetermined positional relationship with respect to the developing roller, a flexible pushing member which is disposed by the side of the back surface of the support plate and has a protrusion formed along the direction of width to come into contact with the back surface of the support plate, and a resilient urging means which is constituted by a plurality of spring members arranged on the back surface of the support plate at a distance in the direction of width thereof and pushes the blade in a direction in which it comes into pressed contact with the peripheral surface of the developing roller via the pushing member and the support plate.

In order to accomplish the above-mentioned second object, the present invention provides a device for developing electrostatic latent image comprising a developing housing, a developing roller disposed in the developing housing to hold, on the peripheral surface thereof, a developing agent in a developing agent-holding zone and convey the thus held developing agent to a developing zone to apply it to the electrostatic latent image, and a developing agent-limiting means for limiting the amount of the developing agent held on the peripheral surface of the developing roller in a developing agent-limiting zone positioned between the developing agent-holding zone and the developing zone, wherein the developing agent-limiting means includes a blade made of a flexible sheet glass of which the one surface is brought into pressed contact with the peripheral surface of the developing roller, a flexible support plate which is mounted on the other surface of the blade and supports the blade maintaining a predetermined positional relationship with respect to the developing roller, and a resilient urging means which is constituted by a plurality of spring members arranged on the back surface of the support plate at a distance in the direction of width thereof and pushes the blade in a direction in which it comes into pressed contact with the peripheral surface of the developing roller via the support plate, and wherein the blade made of the sheet glass has a thickness of from 0.5 to 2.0 mm.

In order to accomplish the above-mentioned third object, the present invention provides a device for developing electrostatic latent image comprising a developing housing, a developing roller disposed in the developing housing to hold, on the peripheral surface thereof, a developing agent in a developing agent-holding zone and convey the thus held developing agent to a developing zone to apply it to the electrostatic latent image, and a developing agent-limiting means for limiting the amount of the developing agent held on the peripheral surface of the developing roller in a developing agent-limiting zone positioned between the developing agent-holding zone and the developing zone, wherein the developing agent-limiting means includes a blade made of a flexible sheet glass of which the one surface is brought into pressed contact with the peripheral surface of the developing roller, a flexible support plate which is mounted on the other surface of the blade and supports the blade maintaining a predetermined positional relationship with respect to the developing roller, and a resilient urging means which pushes the blade in a direction in which it comes into pressed contact with the peripheral surface of the developing roller via the support plate, and wherein the amount of projection of the blade from the center of contact with the peripheral surface of the developing roller to the lower end of the blade is set to be from 0.5 to 2.0 mm.

In order to accomplish the above-mentioned fourth object, the present invention provides a device for developing electrostatic latent image comprising a developing housing, a developing roller disposed in the developing housing to hold, on the peripheral surface thereof, a developing agent in a developing agent-holding zone and convey the thus held developing agent to a developing zone to apply it to the electrostatic latent image, and a developing agent-limiting means for limiting the amount of the developing agent held on the peripheral surface of the developing roller in a developing agent-limiting zone positioned between the developing agent-holding zone and the developing zone, wherein the developing agent-limiting means includes a blade made of a flexible sheet glass of which the one surface is brought into pressed contact with the peripheral surface of the developing roller, a flexible support plate which is mounted on the other surface of the blade and supports the blade maintaining a predetermined positional relationship with respect to the developing roller, and a resilient urging means which pushes the blade in a direction in which it comes into pressed contact with the peripheral surface of the developing roller via the support plate, and wherein the contacting force of the blade exerted on the peripheral surface of the developing roller by the resilient urging means is from 4.0 to 12.0 g/mm as the line pressure.

In order to accomplish the above-mentioned fifth object, the present invention provides a device for developing electrostatic latent image comprising a developing housing, a developing roller disposed in the developing housing to hold, on the peripheral surface thereof, a developing agent in a developing agent-holding zone and convey the thus held developing agent to a developing zone to apply it to the electrostatic latent image, and a developing agent-limiting means for limiting the amount of the developing agent held on the peripheral surface of the developing roller in a developing agent-limiting zone positioned between the developing agent-holding zone and the developing zone, wherein the roughness Rz (ten-point average roughness specified under JIS B 0601) of the peripheral surface of the developing roller is set to be from 5.0 to 12.0 $\mu$m.

In order to accomplish the above-mentioned sixth object, the present invention provides a device for developing electrostatic latent image comprising a developing housing, a developing roller disposed in the developing housing to hold, on the peripheral surface thereof, a developing agent in a developing agent-holding zone and convey the thus held developing agent to a developing zone to apply it to the electrostatic latent image, and a developing agent-limiting means for limiting the amount of the developing agent held on the peripheral surface of the developing roller in a developing agent-limiting zone positioned between the developing agent-holding zone and the developing zone, wherein the developing agent-limiting means includes a blade made of a flexible sheet glass of which the one surface is brought into pressed contact with the peripheral surface of the developing roller, a flexible support plate which is mounted on the other surface of the blade and supports the blade maintaining a predetermined positional relationship with respect to the developing roller, and a resilient urging means which pushes the blade in a direction in which it comes into pressed contact with the peripheral surface of the developing roller via the support plate, and wherein the developing roller is constituted by a rotary shaft formed of a metal material and a solid synthetic rubber roller fitted onto the rotary shaft, and the developing roller has an Asker's C hardness of from 60 to 80.

In order to accomplish the above-mentioned seventh object, the present invention provides a device for developing electrostatic latent image comprising a developing housing, a developing roller disposed in the developing housing to hold, on the peripheral surface thereof, a developing agent in a developing agent-holding zone and convey the thus held developing agent to a developing zone to apply it to the electrostatic latent image, a replenishing roller which is disposed in parallel with the developing roller and feeds the developing agent onto the peripheral surface of the developing roller in the developing agent-holding zone, and a developing agent-limiting means for limiting the amount of the developing agent held on the peripheral surface of the developing roller in a developing agent-limiting zone positioned between the developing agent-holding zone and the developing zone, wherein the developing agent-limiting means includes a flexible blade having a thickness of from 0.1 to 2.0 mm, of which the one surface is brought into pressed contact with the peripheral surface of the developing roller, a flexible support plate which is mounted on the other surface of the blade and supports the blade maintaining a predetermined positional relationship with respect to the developing roller, and a resilient urging means which pushes the blade in a direction in which it comes into pressed contact with the peripheral surface of the developing roller via the support plate, and wherein the nipping width in which the developing roller and the replenishing roller come into contact with each other is set to be from 0.1 to 0.6 mm.

Other objects and features of the present invention will become apparent from the following description.

DETAILED DESCRIPTION OF THE PREFERRED EMBODIMENTS

Preferred embodiments of the device for developing electrostatic latent image constituted according to the present invention will now be described in further detail with reference to the accompanying drawings.

Figure 1:
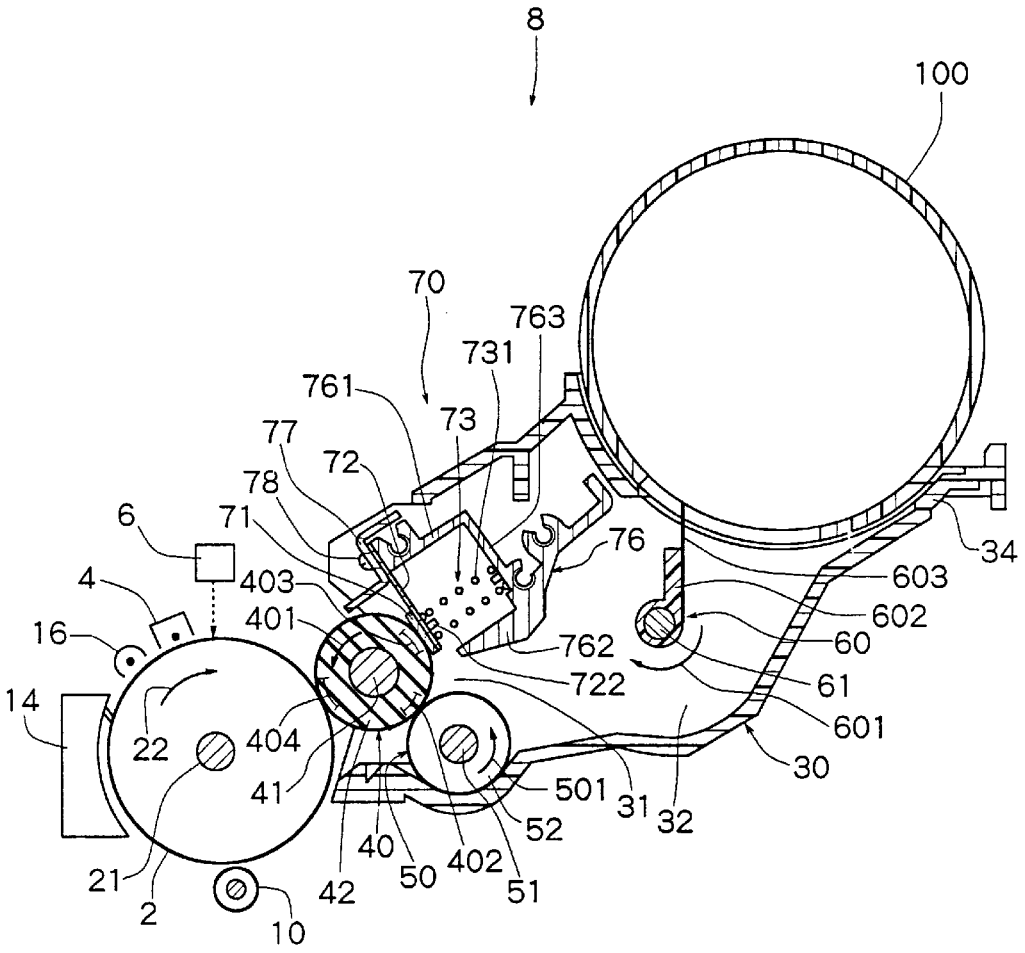
FIG. 1 is a sectional view schematically illustrating the constitution of an image-forming machine equipped with a device for developing electrostatic latent image constituted according to an embodiment of the present invention.

FIG. 1 illustrates an image-forming machine equipped with the device for developing electrostatic latent image constituted according to the present invention. The illustrated image-forming machine is equipped with a rotary drum 2 having, arranged on the peripheral surface thereof, an electrostatic photosensitive material that serves as an image carrier. The rotary drum 2 is mounted by means of a rotary shaft 21 in a machine housing that is not shown, and is allowed to freely rotate. Around the rotary drum 2 that rotates in a direction of an arrow 22, there are arranged a corona discharger 4 for charging the photosensitive layer of the rotary drum 2 to a particular polarity, a laser optical device 6 which is an exposure means for forming an electrostatic latent image on the photosensitive layer of the rotary drum 2 charged to the particular polarity by the corona discharger, a device 8 for developing electrostatic latent image formed by a laser beam irradiated from the optical device 6 into toner image, a transfer roller 10, a cleaning device 14 and a charge-removing lamp 16, as viewed in a direction of rotation.

The device 8 for developing electrostatic latent image is equipped with a developing housing 30 that can be formed of a synthetic resin. In the developing housing 30 are arranged a developing roller 40, a replenishing roller 50, a stirring means 60 and a developing agent-limiting means 70. On the developing housing 30 is mounted a toner cartridge 100 as a developing agent container.

The developing housing 30 is formed of a synthetic resin, and has a developing chamber 31 and a stirrer chamber 32. The developing housing 30 is provided at an upper portion thereof with a toner cartridge-mounting portion 34 having an opening 33 in the upper part thereof, and a toner cartridge 100 is mounted on the mounting portion 34.

The developing roller 40 is disposed in the developing chamber 31 in the developing housing 30, and includes a rotary shaft 41 that is supported between both side walls (not shown) of the developing housing 30 so as to rotate and a solid synthetic rubber roller 42 fitted to the outer peripheral surface of the rotary shaft 41. The rotary shaft 41 can be made of a suitable metal material such as stainless steel. The solid synthetic rubber roller 42 is constituted by a relatively soft material having electrically conducting property or an electrically conducting solid synthetic rubber such as urethane rubber. In the illustrated embodiment, the peripheral surface of the solid synthetic rubber roller 42 has a roughness, i.e., a ten-point average roughness Rz as stipulated under JIS B 0601, of 5.0 to 12.0. The solid synthetic rubber roller 42 has a volume resistivity of from about $10^6$ to about $10^9$ Ω.cm. In the developing roller 40 constituted by the rotary shaft 41 made of a metal material and the solid synthetic rubber roller 42 fitted to the outer peripheral surface of the rotary shaft 41, the rotary shaft 41 has an outer diameter of, for example, 8 to 10 mm and the solid synthetic rubber roller 42 has an outer diameter of, for example, 16 mm. When the rotary shaft 41 has an outer diameter of 8 mm, therefore, the solid synthetic rubber roller 42 has a thickness of 4 mm in the radial direction and when the rotary shaft 41 has an outer diameter of 10 mm, the solid synthetic rubber roller 42 has a thickness of 3 mm in the radial direction. When a rubber that constitutes the solid synthetic rubber roller 42 has the same hardness, therefore, the hardness of the developing roller as an assembly varies. That is, the hardness of the developing roller using the rotary shaft of an outer diameter of 8 mm becomes smaller than that of the developing roller using the rotary shaft of an outer diameter of 10 mm. In the illustrated embodiment, the developing roller, as an assembly, constituted by the rotary shaft 41 and the solid synthetic rubber roller 42 fitted to the outer peripheral surface of the rotary shaft 41 has a hardness of from 60 to 80 in terms of Asker's C hardness. The roller 42 of the thus constituted developing roller 40 is exposed through the opening formed in the developing housing 30 and is positioned being opposed to the rotary drum 2. The peripheral surface of the roller 42 constituting the developing roller 40 is brought into pressed contact with the peripheral surface of the rotary drum 2, and is elastically compressed to some extent in the press-contacted region. The rotary shaft 41 of the developing roller 40 is continuously rotated by a drive means that is not shown, in a direction indicated by an arrow 401 in FIG. 1. With the rotation of the rotary shaft 41, the roller 42 is also continuously rotated in the direction indicated by the arrow 401, and the peripheral surface of the roller 42 passes through a developing agent-holding zone 402, developing agent-limiting zone 403 and developing zone 404, successively. In the illustrated embodiment, a constant voltage of 300 V is applied to the rotary shaft 41 of the developing roller 40.

Figure 2:
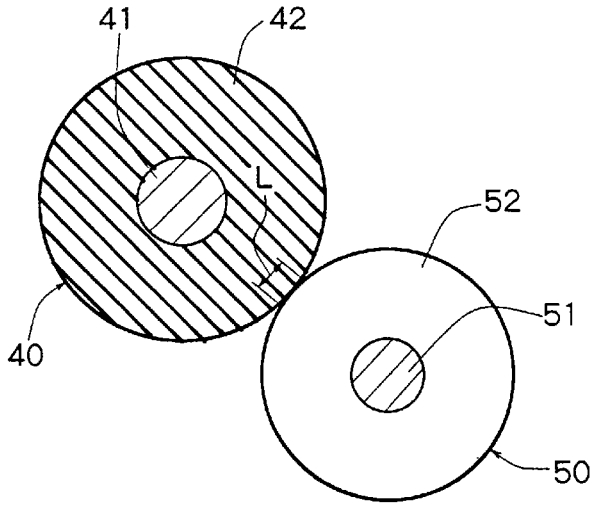
FIG. 2 is an explanation view illustrating a relationship between a developing roller and a replenishing roller mounted on the device for developing electrostatic latent image shown in FIG. 1.

The replenishing roller 50 is disposed in the developing chamber 32 in the developing housing 30 in parallel with the developing roller 40, and includes a rotary shaft 51 rotatably supported between both side walls (not shown) of the developing housing 30 and a roller 52 fitted to the outer peripheral surface of the rotary shaft 51. Like the rotary shaft 41 of the developing roller 40, the rotary shaft 51 can be made of a suitable metal material such as stainless steel. The roller 52 is constituted by a foamed material such as foamed silicon or foamed urethane. The foamed material constituting the roller 52 has a hardness which is considerably smaller than the hardness of the roller 42 of the developing roller 40. For example, a material having an Asker's C hardness of about 35 is used as the foamed material. The roller 42 of the developing roller 40 and the roller 52 of the replenishing roller 50 are brought into pressed contact on their peripheral surfaces as shown in FIG. 2, and a nipping width (L) in which they come in contact with each other is set to be from 0.1 to 0.6 mm. That is, the distance between the axis of the developing roller 40 and that of the replenishing roller 50 is so set that the nipping width (L) lies from 0.1 to 0.6 mm. The roller 52, too, has electrically conducting property, and has a volume resistivity of from about $10^6$ to about $10^9$ Ω.cm. The roller is continuously rotated by a drive means that is not shown, in a direction indicated by an arrow 501 in FIG. 1. In the illustrated embodiment, the rotary shaft 51 of the developing roller 50 is impressed with a constant voltage of 450 V which is higher than the voltage applied to the developing roller 40.

The stirring means 60 is disposed in the stirrer chamber 32 of the developing housing 30 in parallel with the replenishing roller 52, and includes a rotary shaft 61 supported rotatably between both side walls (not shown) of the developing housing 30, a stirrer member 62 fitted to the rotary shaft 61, and a resilient stirrer sheet member 63 mounted on the stirrer member 62. The stirrer member 62 is made of a synthetic resin and has a plurality of openings formed in the direction of width thereof. The stirrer sheet member 63 is made of, for example, a polyethylene terephthalate (PETP) resin and has, at its end portion, openings that correspond to the openings formed in the stirrer member 62, and is fastened to the stirrer member 62 using an adhesive or the like. The other end of the stirrer sheet member 63 protrudes beyond the stirrer member 62. The thus constituted stirring means 60 is continuously rotated by a drive means that is not shown, in a direction indicated by an arrow 601 in FIG. 1.

The developing agent-limiting means 70 comprises a flexible blade 71 brought into pressed contact with the peripheral surface of the roller 42 which constitutes the developing roller 40, a flexible support plate 72 constituting a support means of the blade 71, a resilient urging means 73 that pushes one surface of the blade 71 toward a direction to come into contact with the peripheral surface of the roller 42, and a support holder 76 for supporting the blade 71, support plate 72 and resilient urging means 73.

The support holder 76 is formed by, for example, extrusion-molding an aluminum alloy. The support holder 76 has a length in the direction of width which corresponds to a distance between both side walls of the developing housing 30, and comprises an upper wall 761 for mounting the upper end of the support plate 72, a lower wall 762 formed at a predetermined distance from the upper wall 761, and a rear wall 763 that connects the upper wall 761 to the rear end of the lower wall 762. The thus constituted support holder 76 is disposed at a predetermined position between both side walls of the developing housing 30, and is mounted on the developing housing 30 by a fastening means such as tightening bolts (not shown) that is fitted penetrating through both side walls of the developing housing 30.

Figure 9:
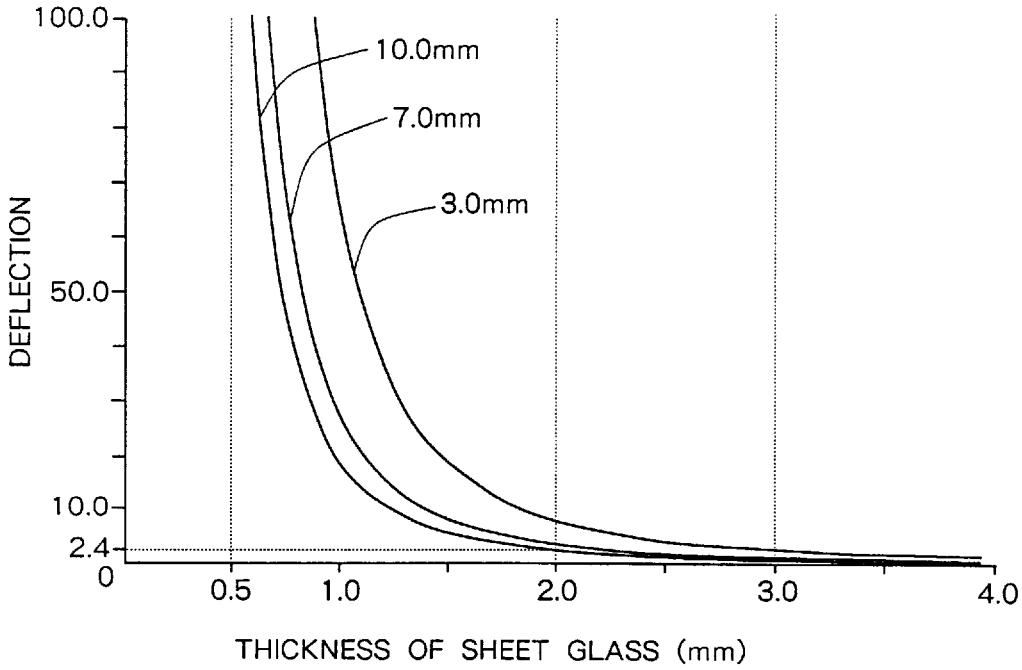
FIG. 9 is a diagram illustrating a relationship between the thickness and the amount of deflection of a sheet glass used as the blade constituting the developing agent-limiting means.

The flexible blade 71 has a length in the direction of width which corresponds to the length of the roller 42 that constitutes the developing roller 40, and has at least one surface thereof (surface brought into pressed contact with the peripheral surface of the roller 42 constituting the developing roller 40) constituted by a flat plate-like member that extends in the direction of width (direction perpendicular to the surface of the paper in FIG. 1) along the peripheral surface of the roller 42. It is desired that at least the region of one surface of the blade 71 brought into pressed contact with the peripheral surface of the roller 42 has a sufficiently small surface roughness and a ten-point average roughness Rz specified under JIS B 0601 of from 5.0 to 12.0. As the surface roughness on one surface of the blade 71 becomes too great, the surface of the toner layer formed on the peripheral surface of the roller 42 that constitutes the developing roller 40 is not flattened to a sufficient degree and is liable to be nonuniform. A sheet glass placed in the market can be exemplified as a suitable material that can be used as the blade 71 relatively cheaply yet exhibiting a sufficiently small roughness, a high hardness and a large abrasion resistance. The sheet glass having a thickness of about 0.5 to 2.0 mm can be used. By using three kinds of sheet glasses having a length of 218 m and widths of 3.0 mm, 7.0 mm and 10.0 mm, the present inventors have tested the amount of deflection and have obtained the results as shown in FIG. 9. The amounts of deflection of FIG. 9 are those when the amount of deflection of a sheet glass having a length of 218 mm, a width of 7.0 mm and a thickness of 3.0 mm is regarded to be 1. The sheet glass having a length of 218 mm, a width of 7.0 mm and a thickness of 3.0 mm is a nearly rigid material and, according to experiments conducted by the present inventors, poorly follows the peripheral surface of the developing roller. If the developing roller and the blade become out of parallel, the contacting force of the blade no longer becomes uniform in the direction of the width, and the thickness of the toner layer formed on the peripheral surface of the developing roller varies in the axial direction. According to experiments conducted by the present inventors, on the other hand, it was found that when the amount of deflection of the blade 72 is not smaller than 2.4, the blade follows the deflection of the shaft of the developing roller and exerts a uniform contacting force over the whole width in the lengthwise direction. The blade 71 deflects by an amount which is not smaller than 2.4 when it is made of a sheet glass having a width of 10.0 mm and a thickness of not larger than 2.0 mm. It was further learned that the sheet glass tends to be cracked during the operation when its thickness is not larger than 0.5 mm. It is therefore desired that the sheet glass constituting the blade 71 has a thickness of from 0.5 to 2.0 mm. When it is desired to apply a required voltage to the blade 71 to control the charging property of the toner, an electrically conducting film may be applied to one surface of the sheet glass. The blade 71 can also be constituted by using a suitable flexible metal plate such as of a stainless steel in place of using the sheet glass. To sufficiently decrease the surface roughness on one surface of the metal plate constituting the blade 71, a suitable surface treatment may be effected for one surface of the metal plate, as required.

Figure 3:
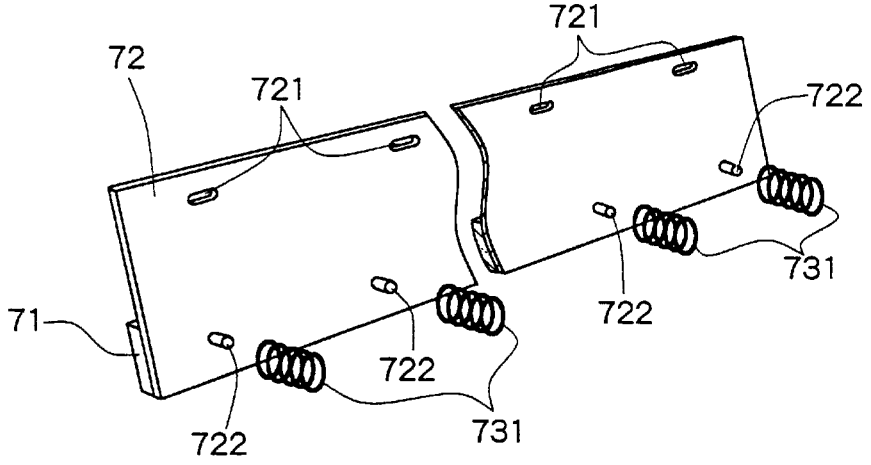
FIG. 3 is a perspective view of a blade and a support plate constituting a developing agent-limiting means mounted on the device for developing electrostatic latent image shown in FIG. 1.

In the illustrated embodiment, the support plate 72 is constituted by a plate spring member such as thin spring steel plate or thin stainless steel plate, and has a length in the direction of width nearly the same as that of the blade 71. The support plate 72 must have flexibility and, hence, it is desired to use a steel plate having a thickness of about 0.1 mm. As shown in FIG. 3, the support plate 72 has a plurality of oval holes 721 (five holes in the illustrated embodiment) formed in the upper end portion thereof at a predetermined distance in the direction of width. To the back surface at the lower portion of the support plate 72 are attached a plurality of spring support projections 722 (six spring support projections in the illustrated embodiment) at an equal distance in the direction of the width. The thus constituted support plate 72 is fastened at the surface of the lower end thereof to the other surface of the blade 71 by a fastening means such as adhesive agent. When it is desired to apply a required voltage to the blade 71 to control the charging property of the toner, an electrically conducting adhesive is used as the fastening means thereby to allow to apply the required voltage to the blade 71 through the support plate 72. As described above, the support plate 72 fastened to the other surface of the blade 71 is fastened and supported by using screws 78 that engage, through a patch 77 and the holes 721, with the end surface of the upper wall 761 that constitutes the support holder 76 at the upper end thereof.

The resilient urging means 73 comprises a plurality of compression coil springs 731 (six compression coil springs in the illustrated embodiment), is disposed on the spring support projections 722 attached to the back surface of the support plate 72, and is arranged between the spring support projections and the rear wall 763 that constitutes the support holder 76. When the back surface of the support plate 72 is pushed by the resilient urging means 73 constituted by the plurality of compression coil springs 731 that are arranged at an equal distance in the direction of width, the one surface of the blade 71 is uniformly brought into pressed contact with the surface of the roller 42 constituting the developing roller 40 over the whole width even though the shaft of the developing roller 40 is deflected to some extent since the support plate 72 and the blade 71 have flexibility. The contacting force of the blade 71 acting on the peripheral surface of the roller 42 constituting the developing roller 40 can be suitably set depending upon the thickness of the developing agent layer that is to be formed on the peripheral surface of the roller 42. The thickness of the developing agent layer formed on the peripheral surface of the roller 42 decreases with an increase in the contacting force. As the pressing force becomes excessive, on the other hand, smooth rotation of the roller 42 is likely to be impaired. In the developing system of the illustrated embodiment, in general, the toner layer formed on the peripheral surface of the roller 42 is from about 20 to about 35 $\mu$m. To suitably form the developing agent layer having such a thickness, the blade 71 should be brought into pressed contact with the peripheral surface of the roller 42 with a line pressure (pressure per a unit length in the direction of width) of from 4.0 to 12.0 g/mm.

Figure 8:
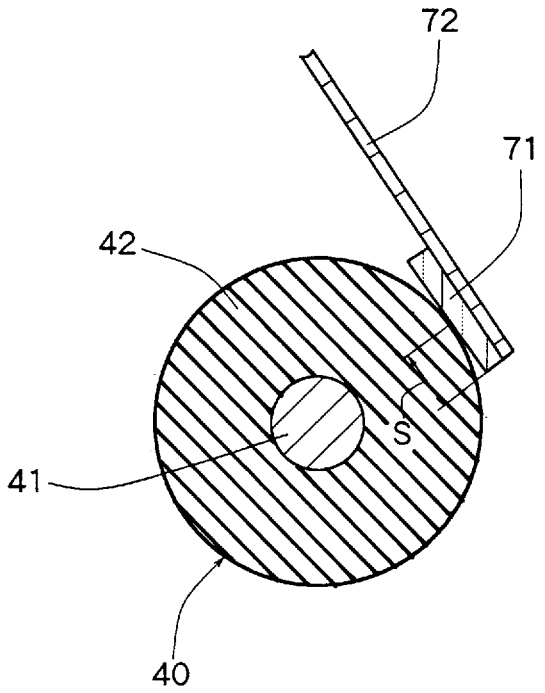
FIG. 8 is an explanation view illustrating a relationship between the blade and the developing roller constituting the developing agent-limiting means that will be mounted on the device for developing electrostatic latent image shown in FIG. 1 or 4.

It is desired that, as shown in FIG. 8, the lower end of the blade 71 is slightly protruded toward the upstream side, as viewed in a direction in which the roller 42 moves, beyond a portion where the blade 71 is contacted to the roller 42 constituting the developing roller 40. In the illustrated embodiment, the amount (S) of projection of the blade 71 from the center of contact with the roller 42 to the lower end of the blade 71 is set to be from 0.5 to 2.0 mm. When the amount (S) of projection is smaller than 0.5 mm, the limiting action by the blade 71 becomes so excessive that it becomes difficult to form a favorable developing agent layer. When the amount (S) of projection becomes larger than 2.0 mm, on the other hand, the thickness of the developing agent layer formed becomes too great and loses stability.

Figure 4:
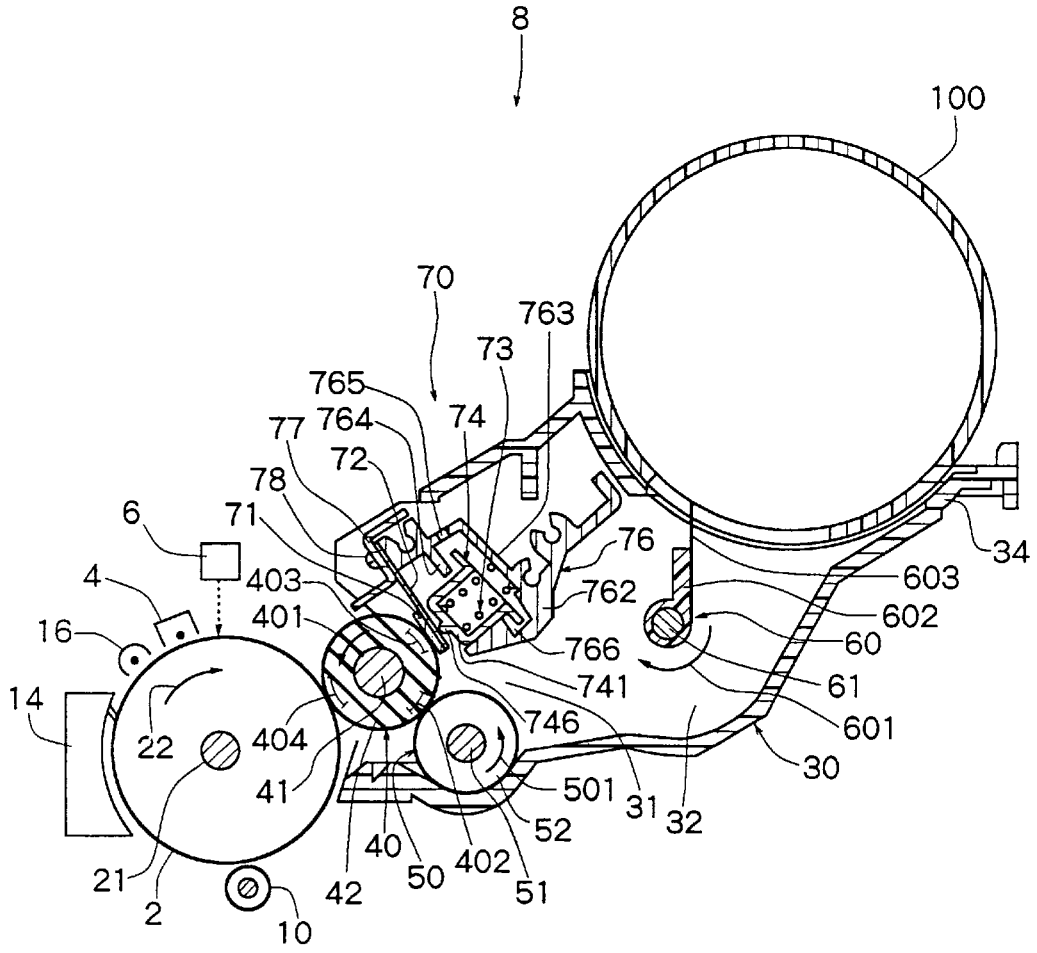
FIG. 4 is a sectional view schematically illustrating the constitution of the image-forming machine mounting the device for developing electrostatic latent image constituted according to another embodiment of the present invention.

Another embodiment of the limiting means 70 will now be described with reference to FIGS. 4, 5 and 6. The image-forming machine equipped with the device for developing electrostatic latent image constituted according to the present invention shown in FIG. 4 is substantially the same as the embodiment shown in FIGS. 1 to 3 except the developing agent-limiting means 70. Therefore, the same portions are denoted by the same reference numerals but are not described again.

The support holder 76 in this embodiment has a guide rail 764 that inwardly protrudes at an intermediate portion of the upper wall 761 and extends in the direction of the whole width and, further, has a plurality of pin-insertion holes 765 (three pin-insertion holes in the illustrated embodiment) formed between the guide rail 764 of the upper wall 761 and the rear wall 763. In the lower wall 762 is formed a guide groove 766 extending in the direction of the whole width from the rear wall 763 up to a position corresponding to the guide rail 764.

Figure 5:
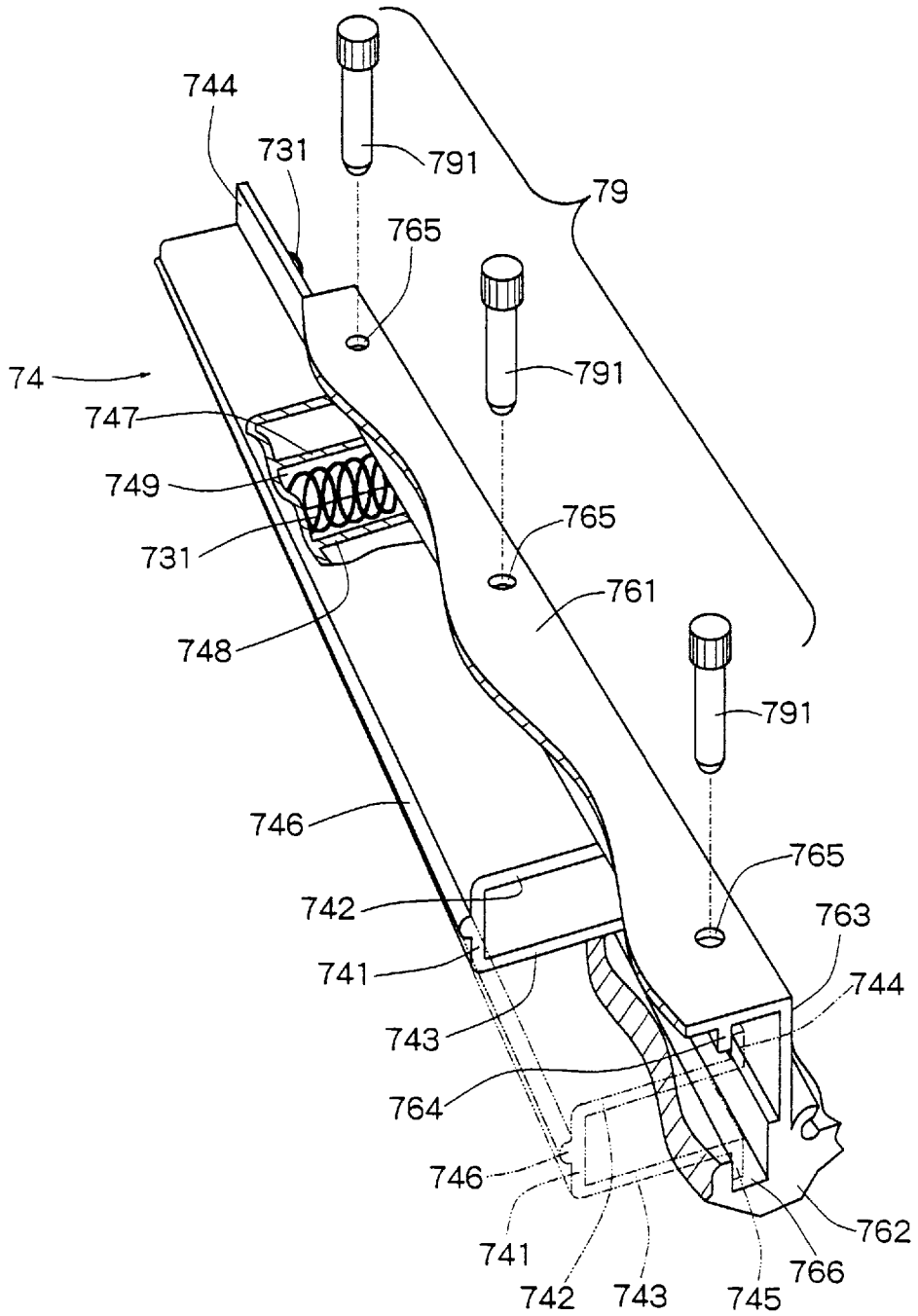
FIG. 5 is a perspective view illustrating, partly in a cut-away manner, major portions of the developing agent-limiting means mounted on the device for developing electrostatic latent image shown in FIG. 4.
Figure 6:
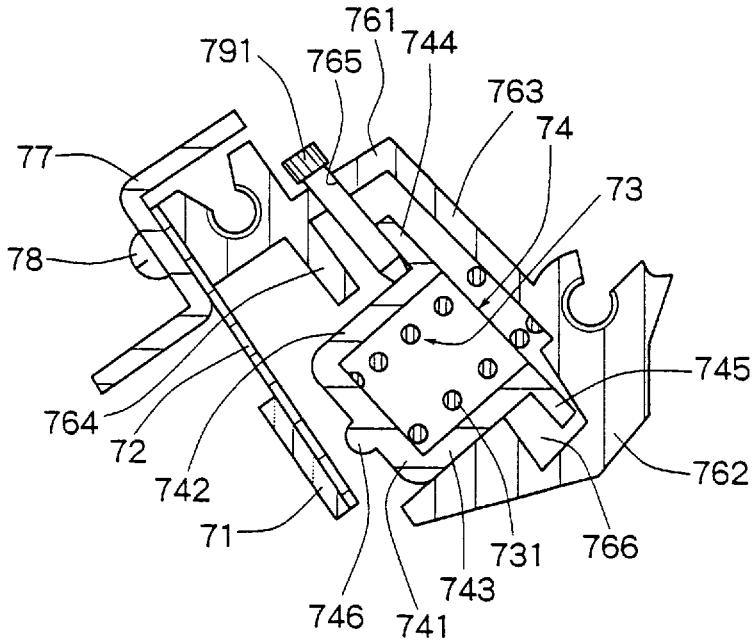
FIG. 6 is a sectional illustrating an assembly state of the developing agent-limiting means that will be mounted on the device for developing electrostatic latent image shown in FIG. 4.

In the embodiment shown in FIGS. 4 to 6, a pushing member 74 is disposed between the support plate 72 and the resilient urging means 73. The pushing member 74 has a length in the direction of the width which is nearly the same as that of the blade 71 and has the shape of a hat in cross section of which the rear end is opened, and is constituted by a front wall 741 that is opposed to the support plate 72, an upper wall 742, a lower wall 743, and guide support portions 744 and 745 that extend upwards and downwards from the rear ends of the upper wall 742 and the lower wall 743, respectively. A protrusion (elongated protrusion) 746 is formed on the front surface of the front wall 741 to constitute a pushing portion at an intermediate portion in the up-and-down direction over the whole width. Between the upper wall 742 and the lower wall 743, furthermore, there are formed a plurality of spring-fitting chambers 749 (six chambers in the illustrated embodiment) by partitioning walls 747 and 748 formed at an equal distance in the direction of width, and a compression coil spring 731 is fitted in each of the chambers. The thus constituted pushing member 74 is molded as a unitary structure using, for example, a synthetic resin. It is important that the pushing member 74 has flexibility. The end on one side of the compression coil spring 751 is fitted to each of the plurality of spring-fitting chambers 749 formed in the pushing member 74, and the end on the other end thereof is brought into contact with the front surface of the intermediate wall 763 constituting the support holder 76. By being constituted as described above, the pushing forces of the plurality of compression coil springs 751 disposed in the direction of the width of the pushing member 74 at an equal distance, act on the blade 71 via the pushing member 74 and the support plate 72 causing one surface of the blade 71 to be brought into pressed contact with the surface of the roller 42. In this case, the one surface of the blade 71 is brought into pressed contact with the surface of the roller 42 constituting the developing roller 40 uniformly over the whole width even though the shaft of the developing roller 40 is deviated to some extent since the pushing member 74, support plate 72 and blade 71 have flexibility. The support plate 72 mounted on the blade 71 is pushed by the protrusion 746 formed on the front surface of the pushing member 74. Since the contact area is small, therefore, a stable and uniform pushing force is obtained over the whole width.

The developing agent-limiting means 70 has a pressure-canceling means 79 for canceling the pressure exerted on the support plate 72 and on the blade 71 by the resilient urging means 73. In the illustrated embodiment, the pressure-canceling means 79 has three stopper pins 791. At the time of assembling the developing agent-limiting means 70, the three stopper pins 791 are inserted, as shown in FIG. 6, in the three pin-insertion holes 765 formed between the rear wall 763 and the guide rail 764 of the upper wall 761 that constitutes the support holder 76, and act on the front surface of the guide support portion 764 that constitutes the pushing member 74 to cancel the pressing force of the resilient urging means 73 acting on the back surface of the support plate 72. After the developing agent-limiting means 70 is assembled on a predetermined portion of the developing device 8, the three stopper pins 791 are removed from the pin-insertion holes 765, so that the pushing forces of the compression coil springs 751 act on the back surface of the support plate 72 as shown in FIG. 4.

Described below is the procedure for assembling the developing agent-limiting means 70 and for mounting the developing agent-limiting means 70 in the developing housing 30. In assembling the developing agent-limiting means 70, an end of the compression coil spring 731 is, first, fitted to the spring-fitting chamber 749 of the pushing member 74, as shown in FIG. 5, and while being compressed, the compression coil spring 731 is inserted from an end of the support holder 76 toward the other end of the holder 76. At this time, the guide support portion 744 of the upper side of the pushing member 74 is located between the rear wall 463 and the guide rail 764, and the guide support portion 745 of the lower side is located in the guide groove 766, so that the pushing member 74 is inserted in a predetermined position of the support holder 76 to form the resilient urging means 73. When the resilient urging means 73 is mounted on the support holder 76, as described above, the front wall 741 of the pushing member 74 is pushed toward the rear wall 763 against the force of the compression coil springs 731, so that the guide support portion 744 is moved toward the side of the rear wall 763 beyond the pin-insertion holes 765. In this state, stopper pins 79 are inserted in the pin-insertion holes 765 as shown in FIG. 6, whereby the stopper pins 79 act on the front surface of the guide support portion 764 that constitutes the pushing member 74 to limit the forward motion of the pushing member 74, so that the pushing forces of the compression coil springs 731 no longer act on the back surface of the support plate 72. In the state where the action of the pushing forces of the compression coil springs 731 is canceled, the upper end of the support plate 72 fastened to the other surface of the blade 71 is fitted by screws 78 to the end surface of the upper wall 761 that constitutes the holder 76. The developing agent-limiting means 70 that is assembled in a state where the pushing force acting on the back surface of the support plate 72 is canceled, is disposed at a predetermined position shown in FIG. 3 between the two walls of the developing housing 30, and is mounted using a fastening means such as tightening bolts (not shown) that is fitted penetrating through both walls of the developing housing 30. After the developing agent-limiting means 70 is mounted at the predetermined position in the developing housing 30, the stopper pins 79 are removed from the pin-insertion holes 765, whereby the pushing member 74 is permitted to move forward, i.e., toward the support plate 72, and the protrusion 746 formed on the front surface of the pushing member 74 is pushed onto the back surface of the support plate 72 by the compression coil springs 731. As described above, since the developing agent-limiting means 70 according to the illustrated embodiment is assembled in a state where the pushing force acting on the back surface of the support plate 72 on which the blade 71 is mounted is canceled, the peripheral surface of the developing roller 40 does not suffer from by the blade 71 at the time of mounting the developing agent-limiting means 70 in the developing housing 30.

Figure 7:
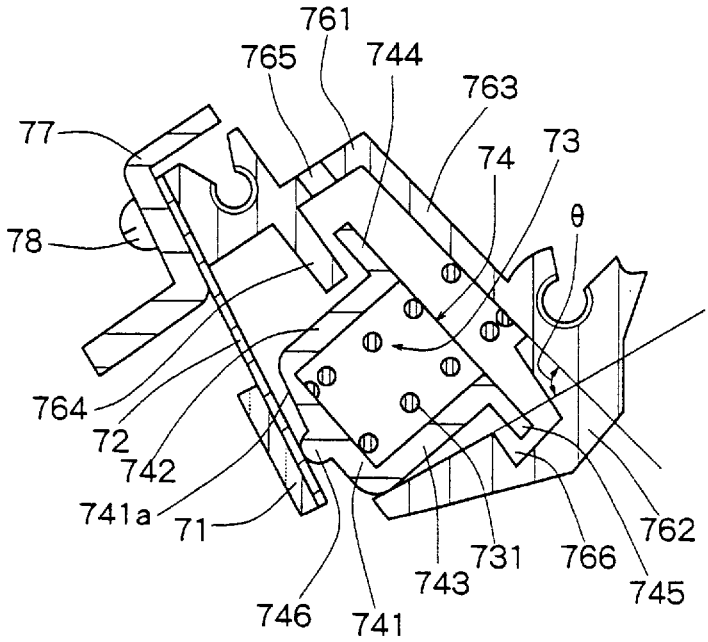
FIG. 7 is a sectional view illustrating another embodiment of the developing agent-limiting means mounted on the device for developing electrostatic latent image constituted according to the present invention.

Described below with reference to FIG. 7 is another embodiment of the developing agent-limiting means 70. In the developing agent-limiting means 70 according to this embodiment, the angle θ formed between the front wall at the rear part of the support holder 76 and the upper surface of the lower wall 762 is set to be smaller than 90 degrees (80 degrees in the illustrated embodiment), and the front lower edge of the pushing member 74 is brought into contact with the upper surface of the lower wall 762. That is, the pushing direction of the compression coil spring 731 or the axial line of the compression coil spring 731 is not in parallel with the upper surface of the lower wall 762 constituting the upport holder 76, and the upper surface of the lower all 762 approaches the axial line of the compression coil spring 731 as it goes forward. Being constituted as described above, the front lower edge of the pushing member 74 is brought into intimate contact with the upper surface of the lower wall 762 constituting the support holder 76 as the pushing member 74 is moved forward by the compression coil spring 731, and the pushing member 74 is urged by the compression coil spring 731 under the thus intimately contacted state. Therefore, the toner is reliably prevented from infiltrating into the developing agent-limiting means 70 from between the pushing member 74 and the upper surface of the lower wall 762 constituting the support holder 76. In the illustrated embodiment, furthermore, the front upper part of the front wall 741 of the pushing member 74 is tilted rearwardly to form an escape 741*a*. According to this constitution, the front upper part of the front wall 741 of the pushing member 74 is prevented from coming into contact with the back surface of the support plate 72.

The device for developing electrostatic latent image according to the illustrated embodiments is constituted as described above. Mentioned below is the operation. Upon starting the operation of the device for developing electrostatic latent image, the roller 42 of the developing roller 40, roller 52 of the replenishing roller 50 and stirring means 60 are rotated in the directions indicated by arrows by a drive means that are not shown. As the stirring means 60 is rotated in the direction indicated by an arrow 601, the developing agent contained in the stirrer chamber 32 is stirred and is fed into the developing chamber 31. Meanwhile, the used developing agent after held on the peripheral surface of the roller constituting the developing roller 40 and passed through the developing zone 404, is transferred onto the surface of the replenishing roller 50 at a portion where the developing roller 40 and the replenishing roller 50 are in contact with each other, and is mixed in the developing chamber 31 together with the developing agent that is fed by the stirring means 60. The developing agent mixed in the developing chamber 31 is held on the peripheral surface of the roller 52 that is made of a foamed material and constitutes the replenishing roller 50, and is conveyed toward the developing roller 40.

The developing agent held on the peripheral surface of the replenishing roller 50 and is conveyed toward the developing roller 40, is supplied to, and is held by, the peripheral surface of the roller 42 constituting the developing roller 40 in the developing agent-holding zone 402, and is conveyed toward the developing agent-limiting zone 403. In the developing agent-limiting zone 403, the blade 71 of the developing agent-limiting means 70 acts on the developing agent held on the peripheral surface of the roller 42 of the developing roller 40, and limits the developing agent held on the peripheral surface of the roller 42 into a predetermined amount to form a thin layer. Here, since the blade 71, support plate 72 and pushing member 74 have flexibility, the one surface of the blade 71 is brought into pressed contact with the surface of the roller 42 of the developing roller 40 uniformly over the whole width even though the shaft of the developing roller 40 may be deflected to some extent.

In the developing zone 404, the developing agent is applied to the electrostatic latent image on electrostatic photosensitive material disposed on the peripheral surface of the rotary drum 2, so that the electrostatic latent image is developed into a toner image. For instance, the electrostatic latent image has a non-imaged region electrically charged to about +600 V and an imaged region electrically charged to about +120 V, and the toner which is the developing agent is adhered to the imaged region (so-called reversal development). The rotary drum 2 is continuously rotated in a direction indicated by an arrow 22 in FIG. 1 and, hence, the peripheral surface of the rotary drum 2 and the peripheral surface of the roller 42 constituting the developing roller 40 move in the same direction in the developing zone 404. The moving speed V2 of the peripheral surface of the roller 42 is set to be slightly larger than the moving speed V1 of the peripheral surface of the rotary drum 2 and it is desired that a relationship between V1 and V2 is 1.2 V1≦V2≦2.2 V1. In this case, the developing agent is conveyed in sufficient amounts into the developing zone 404 by the roller 42 of the developing roller 40, the developing agent adhered to the non-imaged portion of the electrostatic latent image is suitably peeled off by the rubbing action of the peripheral surface of the roller 42 with respect to the peripheral surface of the rotary drum 2 and, thus, a good toner image having a suitable developing density and being free from fogging can be obtained. Desirably, the developing agent comprises only a toner having a volume average particle diameter (Vol. 50%: the volume of the toner having sizes smaller than the volume average particle diameter is equal to the volume of the toner having sizes larger than the volume average particle diameter) of from about 8.0 to 12.0 μm and a volume resistivity of not smaller than $10^8$ Ω.cm.

Figure 10:
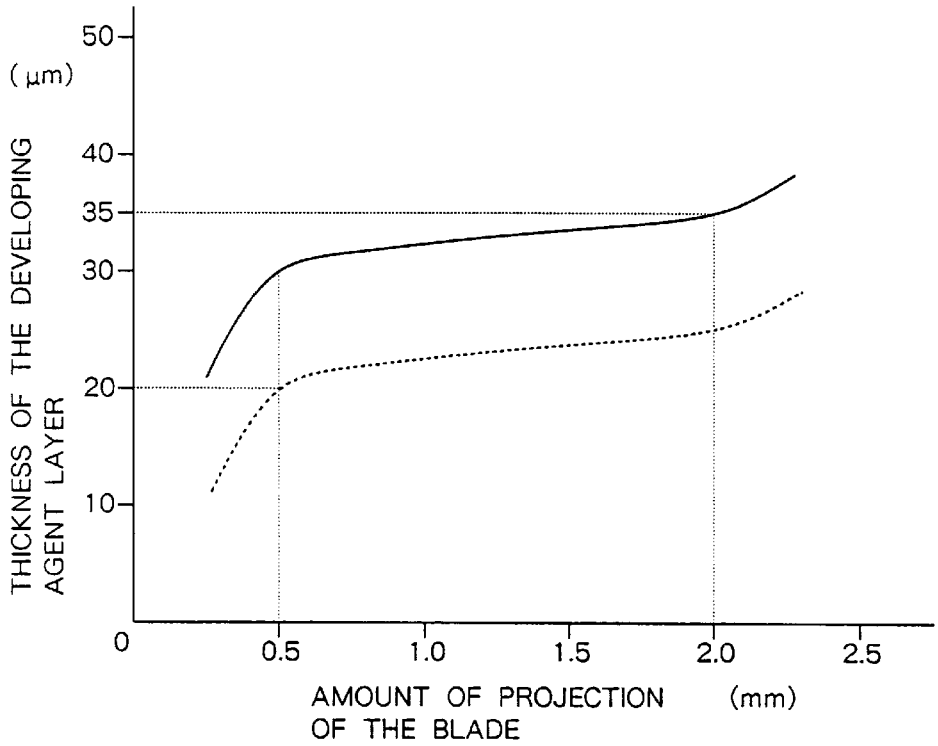
FIG. 10 is a diagram illustrating a relationship between the amount (S) of projection of the blade from the center of contact with the developing roller to the lower end of the blade and the thickness of the developing agent layer formed on the peripheral surface of the developing roller, the blade constituting the developing agent-limiting means which is mounted on the device for developing electrostatic latent image shown in FIG. 4.

Described below is how to set the amount (S) of projection of the blade 71. FIG. 10 is a diagram of experimental results showing a relationship between the thickness of the developing agent layer formed on the peripheral surface of the roller 42 and the amount (S) of projection of the blade 71 constituting the developing agent-limiting means 70 from the center of contact with the roller 42 constituting the developing roller 40 to the lower end of the blade 71 in the device for developing electrostatic latent image shown in FIG. 4. In FIG. 10, a solid line represents values of when the developing roller 40 has a roughness Rz (ten-point average roughness specified under JIS B 0601) of 12.0 μm on the peripheral surface of the roller 42 and the pushing force of the resilient urging means 73, i.e., the contacting force of the blade 71 exerted on the peripheral surface of the roller 42 is 4.0 g/mm as the line pressure (pressure per a unit length in the direction of width). A broken line represents values of when the developing roller 40 has a roughness Rz (ten-point average roughness specified under JIS B 0601) of 5.0 μm on the peripheral surface of the roller 42 and the contacting force of the blade 71 exerted on the peripheral surface of the roller 42 is 12.0 g/mm as the line pressure (pressure per a unit length in the direction of width). As will be understood from the experimental results, when the amount (S) of projection is smaller than 0.5 mm, the thickness of the developing agent layer formed on the peripheral surface of the roller 42 becomes very small. When the amount (S) of projection is not smaller than 2.0 mm, on the other hand, the rate of increase in the thickness of the developing agent layer on the peripheral surface of the roller 42 becomes great. When the amount (S) of projection lies within a range of from 0.5 to 2.0 mm, the thickness of the developing agent layer formed on the peripheral surface of the roller 42 remains stable lying within a range of from 20 to 35 μm even if the roughness Rz (ten-point average roughness specified under JIS B 0601) of the peripheral surface of the roller 42 varies over a range of from 5.0 to 12.0 μm, and the contacting force of the blade 71 upon the peripheral surface of the roller 42 varies over a range of from 4.0 to 12.0 g/mm as the line pressure (pressure per a unit length in the direction of width). Therefore, the amount (S) of projection should be set to lie from 0.5 to 2.0 mm.

Figure 11:
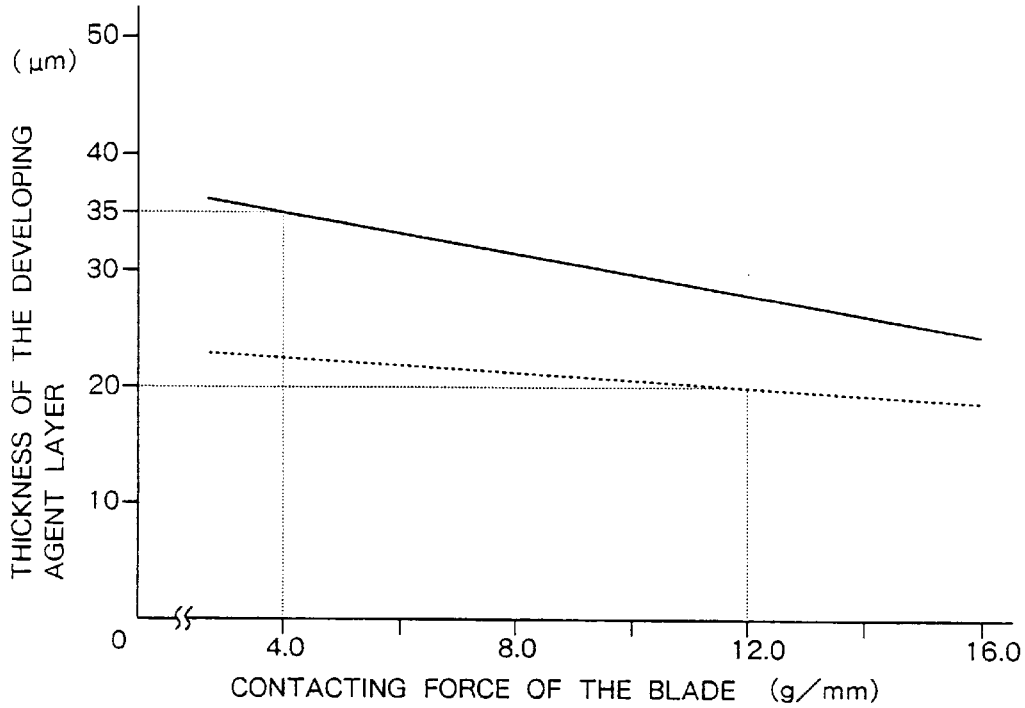
FIG. 11 is a diagram illustrating a relationship between the contacting force (line pressure) of the blade exerted on the developing roller and the thickness of the developing agent layer formed on the peripheral surface of the developing roller, the blade constituting the developing agent-limiting means which is mounted on the device for developing electrostatic latent image shown in FIG. 4.

Described below is how to set the contacting force of the blade 71. FIG. 11 is a diagram of experimental results showing a relationship between the thickness of the developing agent layer formed on the peripheral surface of the roller 42 and the contacting force (line pressure) of the blade 71 constituting the developing agent-limiting means 70 upon the peripheral surface of the roller 42 constituting the developing roller 40 in the device for developing electrostatic latent image shown in FIG. 4. In FIG. 11, a solid line represents values of when the developing roller 40 has a roughness Rz (ten-point average roughness specified under JIS B 0601) of 12.0 μm on the peripheral surface of the roller 42 and the amount (S) of projection of the blade 71 is 2.0 mm. A broken line represents values of when the developing roller 40 has a roughness Rz (ten-point average roughness specified under JIS B 0601) of 5.0 μm on the peripheral surface of the roller 42 and the amount (S) of projection of the blade 71 is 0.5 mm. As will be understood from the experimental results, when the contacting force of the blade 71 lies within a range of from 4.0 to 12.0 g/mm as the line pressure, the thickness of the developing agent layer formed on the peripheral surface of the roller 42 remains stable lying within a range of from 20 to 35 μm even if the roughness Rz (ten-point average roughness specified under JIS B 0601) of the peripheral surface of the roller 42 constituting the developing roller 40 varies over a range of from 5.0 to 12.0 μm, and the amount (S) of projection of the blade 71 varies over a range of from 0.5 to 2.0 mm. Therefore, the contacting force (line pressure) should be set to lie from 4.0 to 12.0 g/mm.

Figure 12:
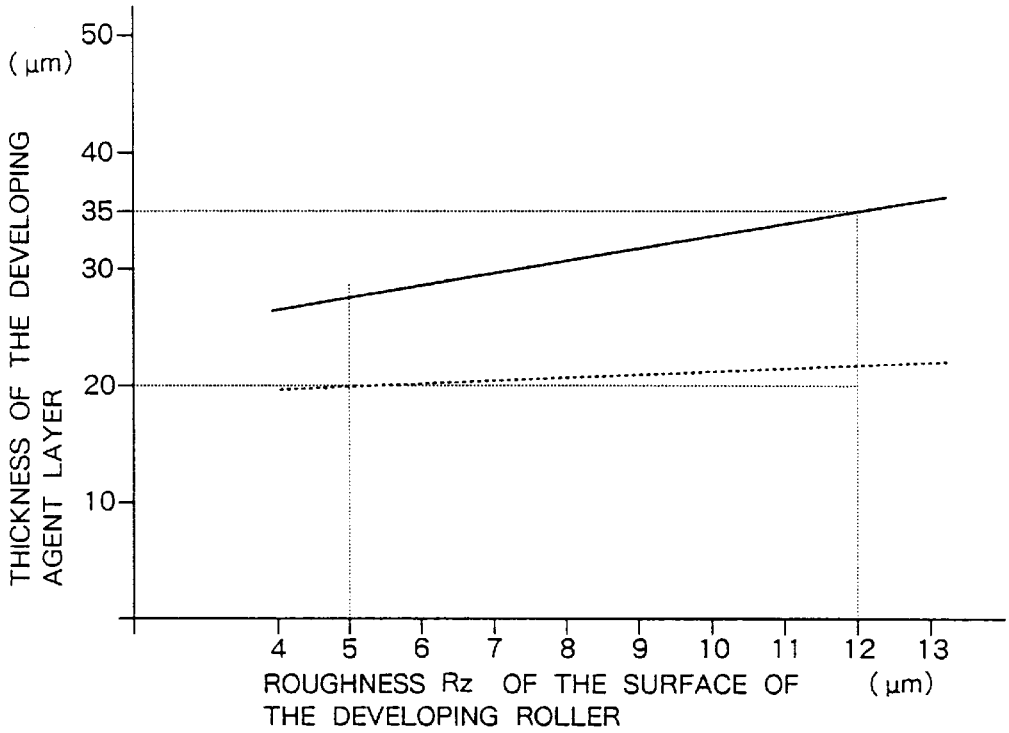
FIG. 12 is a diagram illustrating a relationship between the roughness of the peripheral surface of the developing roller and the thickness of the developing agent layer formed on the peripheral surface of the developing roller which is mounted on the device for developing electrostatic latent image shown in FIG. 4.

Described below is how to set the roughness of the peripheral surface of the roller 40 constituting the developing roller 40. FIG. 12 is a diagram of experimental results showing a relationship between the thickness of the developing agent layer formed on the peripheral surface of the roller 42 and the roughness Rz (ten-point average roughness specified under JIS B 0601) of the peripheral surface of the roller 42 constituting the developing roller 40 in the device for developing electrostatic latent image shown in FIG. 4. In FIG. 12, a solid line represents values of when the amount of projection of the blade 71 from the center of contact with the roller 42 to the lower end of the blade 71 is 2.0 mm, and the pushing force of the resilient urging means 73, i.e., the contacting force of the blade 71 exerted on the peripheral surface of the roller 42 is 4.0 g/mm. A broken line represents values of when the amount of projection of the blade 71 is 0.5 mm and the contacting force of the blade 71 is 12.0 g/mm. As will be understood from the experimental results, when the roughness Rz (ten-point average roughness specified under JIS B 0601) of the peripheral surface of the roller 42 constituting the developing roller 40 lies within a range of from 5.0 to 12.0, the thickness of the developing agent layer formed on the peripheral surface of the roller 42 remains stable lying within a range of from 20 to 35 μm even if the amount of projection of the blade 71 varies over a range of from 0.5 to 2.0 mm and the contacting force of the blade 71 varies over a range of from 4.0 to 12.0 g/mm. Therefore, the roughness Rz (ten-point average roughness specified under JIS B 0601) of the peripheral surface of the developing roller should be set to lie from 5.0 to 12.0 μm.

Figure 13:
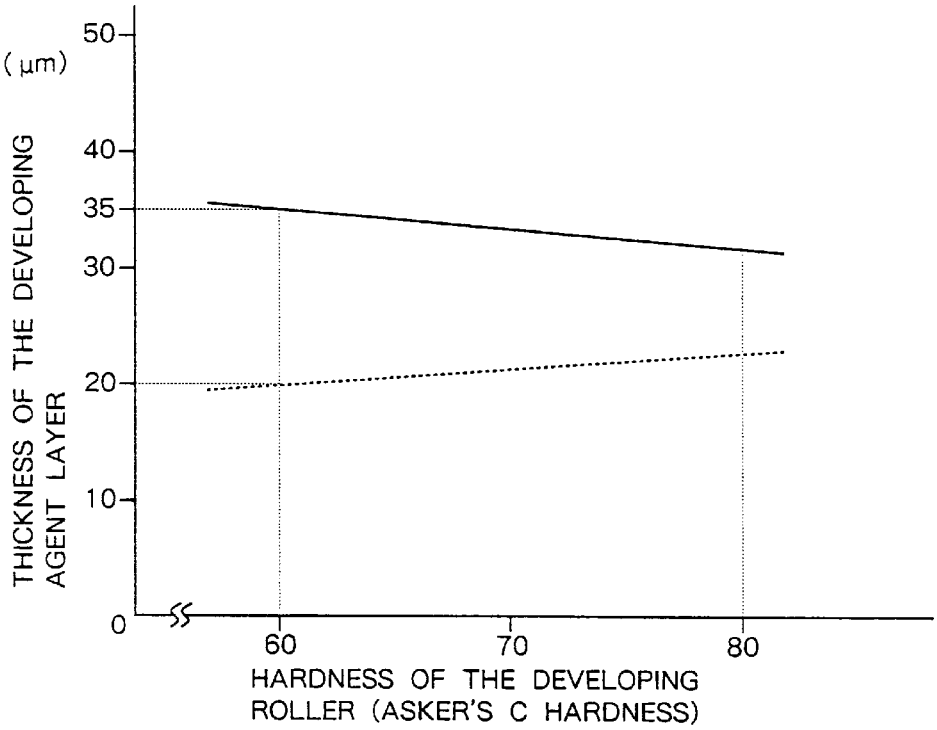
FIG. 13 is a diagram illustrating a relationship between the hardness of the developing roller and the thickness of the developing agent layer formed on the peripheral surface of the developing roller which is mounted on the device for developing electrostatic latent image shown in FIG. 4.

Described below is how to set the hardness of the developing roller 40. FIG. 13 is a diagram of experimental results showing a relationship between the thickness of the developing agent layer formed on the peripheral surface of the solid synthetic rubber roller 42 and the hardness of the developing roller 40 which is an assembly constituted by the rotary shaft 41 and the solid synthetic rubber roller 42 fitted to the outer peripheral surface of the rotary shaft 41 in the device for developing electrostatic latent image shown in FIG. 4. Here, the developing roller is constituted by the rotary shaft having an outer diameter of 10 mm made of a stainless steel and the solid synthetic rubber roller having an outer diameter of 16 mm made of urethane rubbers having various degrees of hardness. In FIG. 13, the abscissa represents the hardness of the developing roller which is an assembly constituted by the rotary shaft and the solid synthetic rubber roller fitted thereon. In FIG. 13, a solid line represents values of when the amount (S) of projection of the blade 71 is 2.0 mm and the contacting force of the blade 71 is 4.0 g/mm as the line pressure. A broken line represents values of when the amount (S) of projection of the blade 71 is 0.5 mm and the contacting force of the blade 71 is 12.0 g/mm as the line pressure. According to the experimental results, when the amount (S) of projection of the blade 71 is 2.0 mm and the contacting force of the blade 71 is 4.0 g/mm as the line pressure, the thickness of the toner layer formed on the surface of the developing roller increases with a decrease in the hardness of the developing roller, and the thickness of the toner layer formed on the surface of the developing roller decreases with an increase in the hardness of the developing roller, as shown by a solid line. On the other hand, when the amount (S) of projection of the blade 71 is 0.5 mm and the contacting force of the blade 71 is 12.0 g/mm as the line pressure, the thickness of the toner layer formed on the surface of the developing roller decreases with a decrease in the hardness of the developing roller, and the thickness of the toner layer formed on the surface of the developing roller increases with an increase in the hardness of the developing roller, as shown by a broken line. When the hardness of the developing roller lies within a range of from 60 to 80 in terms of the Asker's C hardness, the thickness of the developing agent layer formed on the peripheral surface of the solid synthetic rubber roller 42 remains stable within a range of from 20 $\mu$m to 35 $\mu$m even if the amount (S) of projection of the blade 71 varies over a range of from 0.5 to 2.0 mm and the contacting force of the blade 71 varies over a range of from 4.0 to 12.0 g/mm as the line pressure.

It was also learned that variation in the thickness of the toner layer formed on the surface of the developing roller increases as the hardness of the developing roller becomes smaller than 60 in terms of the Asker's C hardness. Desirably, therefore, the lower limit of the hardness of the developing roller 40 should be set to be 60 in terms of the Asker's C hardness, the developing roller 40 being the assembly constituted by the rotary shaft 41 and the solid synthetic rubber roller 42 fitted onto the outer peripheral surface of the rotary shaft 41.

Discussed below is the upper limit of the hardness of the developing roller which is the assembly constituted by the rotary shaft and the solid synthetic rubber roller fitted to the outer peripheral surface of the rotary shaft. As the hardness of the developing roller increases, the thickness of the developing agent formed on the peripheral surface of the developing roller tends to be stabilized within the above-mentioned predetermined range. As the hardness of the developing roller 40 increases, however, the contacting force of the developing roller 40 relative to the rotary drum 2 increases and the mechanical torque increases since the developing roller 40 is brought into contact with the rotary drum 2. Consequently, as the hardness of the developing roller exceeds 80 in terms of the Asker's C hardness, furthermore, it becomes necessary to increase the capacity of the electric motor to drive the rotary drum 2 and the developing roller 40. It is therefore desired to set the upper limit of the hardness of the developing roller 40 which is the assembly constituted by the rotary shaft 41 and the solid synthetic rubber roller 42 fitted to the outer peripheral surface of the rotary shaft 41, to be 80 in terms of the Asker's C hardness.

Figure 14:
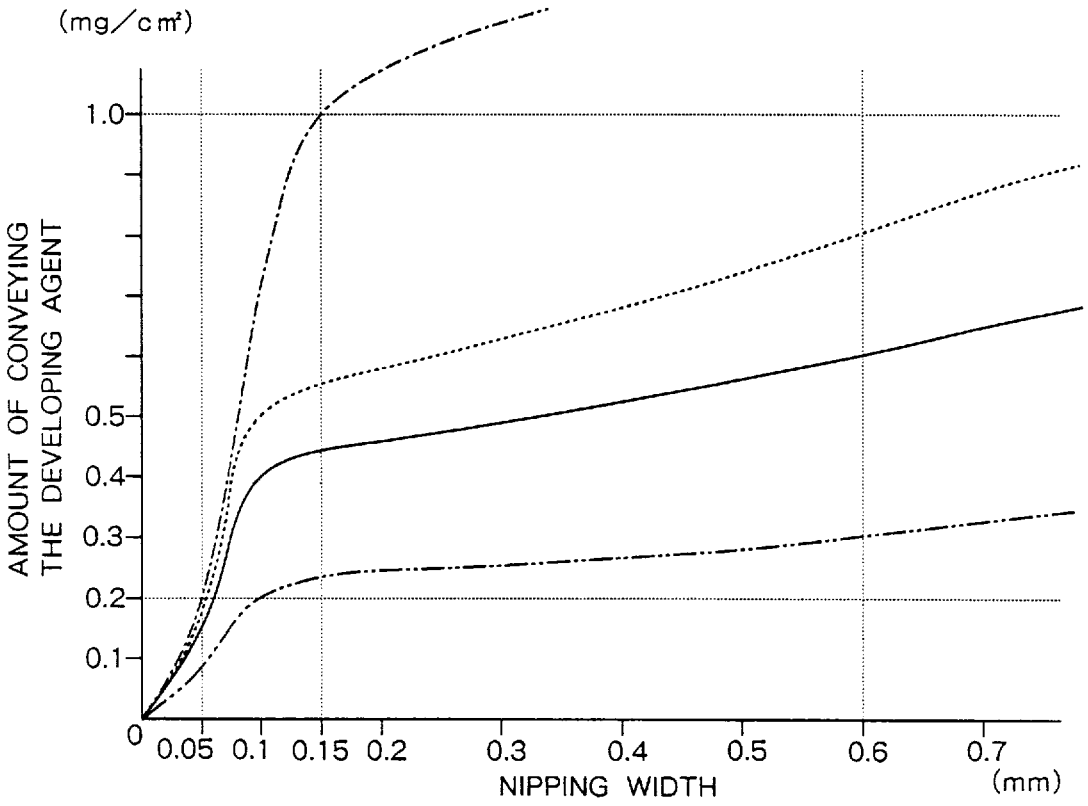
FIG. 14 is a diagram illustrating a relationship between a nipping width (L) in which the peripheral surface of the developing roller comes into contact with the peripheral surface of the replenishing roller and the conveyance amount of the developing agent held on the peripheral surface of the developing roller which is mounted on the device for developing electrostatic latent image shown in FIG. 4.

Next, described below are how to set the thickness of the blade constituting the developing agent-limiting means and how to set the nipping width (L) in which the peripheral surfaces of the developing roller and the replenishing roller come into contact with each other. FIG. 14 is a diagram illustrating a relationship between the nipping width (L) in which the peripheral surface of the roller 42 constituting the developing roller 40 comes into contact with the peripheral surface of the roller 52 constituting the replenishing roller 50 and the conveyance amount of the developing agent which is held on the peripheral surface of the developing roller 42 constituting the developing roller 40 in the device for developing electrostatic latent image shown in FIG. 4.

The conveyance amount of the developing agent is expressed by a value that is obtained by sucking the developing agent held on the peripheral surface of the roller 42 constituting the developing roller 40 over a predetermined area and by dividing the weight of the sucked developing agent by the area. The amount suited for forming the image will be from 0.2 mg/cm$^2$ to 1.0 mg/cm$^2$. For the experiment there are used four kinds of blades 71 constituting the developing agent-limiting means, i.e., a glass blade having a thickness of 1.1 mm, a glass blade having a thickness of 2.0 mm, a glass blade having a thickness of 3.0 mm, and a stainless steel blade having a thickness of 0.1 mm. The pushing force of the resilient urging means 73, i.e., the contacting force of the blade 71 upon the peripheral surface of the roller 42 constituting the developing roller 40, was set to be 7.3 g/mm as the line pressure (pressure per a unit length in the direction of width). As will be understood from the experimental results, in the case where the glass blade having the thickness of 3.0 mm is used, the conveyance amount of the developing agent is about 0.2 mg/cm$^2$ when the nipping width (L) is 0.05 mm, while the conveyance amount of the developing agent is about 1.0 mg/cm$^2$ when the nipping width (L) is 0.15 mm, as represented by a dot-dash chain line in FIG. 14. It will be understood that the developing agent becomes short in supply when the nipping width (L) is smaller than 0.05 mm, while the developing agent becomes excessive in supply when the nipping width (L) is larger than 0.15 mm. The amount of supplying the developing agent exceeds 1.0 mg/cm$^2$ as the nipping width (L) becomes larger than 0.15 mm. This is because, when the glass blade has a large thickness, the developing agent-limiting means fails to perform good developing agent-scraping and the developing agent layer is formed highly densely on the peripheral surface of the developing roller. When the glass blade having the thickness of 3.0 mm is used, therefore, the nipping width (L) must be set to be from 0.05 to 0.15 mm. By taking into consideration the error in manufacturing the developing roller and the replenishing roller and the error in assembling them together, however, a considerably high degree of manufacturing precision is required to produce products confining the nipping width (L) within the range of from 0.05 to 0.15 mm.

In the case where the glass blade having the thickness of 2.0 mm is used, on the other hand, the conveyance amount of the developing agent is about 0.5 mg/cm$^2$ when the nipping width (L) is 0.1 mm and the conveyance amount of the developing agent is about 0.8 mg/cm$^2$ when the nipping width (L) is 0.6 mm, as represented by a broken line in FIG. 14. In the case where the glass blade having the thickness of 1.1 mm is used, furthermore, the conveyance amount of the developing agent is about 0.4 mg/cm$^2$ when the nipping width (L) is 0.1 mm and the conveyance amount of the developing agent is about 0.6 mg/cm$^2$. When the nipping width (L) is 0.6 mm. In the case where the stainless steel blade having the thickness of 0.1 mm is used, furthermore, the conveyance amount of the developing agent is about 0.2 mg/cm$^2$ when the nipping width (L) is 0.1 mm and the conveyance amount of the developing agent is about 0.3 mg/cm$^2$ when the nipping width (L) is 0.6 mm, as represented by a two-dotted chain line in FIG. 14.

Thus, even when the nipping width (L) is 0.6 mm, the conveyance amount of the developing agent can be suppressed to be not larger than 1.0 mg/cm$^2$ on account of the reasons that the blade is thin, flexible and is brought into pressed contact uniformly on the peripheral surface of the developing roller over the whole width, enabling the developing agent-limiting means to exhibit the developing agent-scraping action smoothly and favorably, and permitting the developing agent layer to be formed not so highly densely on the peripheral surface of the developing roller. It is therefore desired that the thickness of the blade which constitutes the developing agent-limiting means is set to be in the range of from 0.1 mm which is the lower limit of when the blade is made of a metal material and with which thickness the blade can be produced substantially easily maintaining flexibility to exhibit suitable developing agent-scraping function to 2.0 mm which is the upper limit of when the blade is made of the glass blade and with which thickness the blade exhibits flexibility and suitable developing agent-scraping function. It is further desired that the nipping width (L) is set to be from 0.1 to 0.6 mm. When the sheet glass constituting the blade has a thickness which is smaller than 0.5 mm, the sheet glass may be cracked during the operation. When the glass blade is used, therefore, it is desired that the thickness is set to be from 0.5 to 2.0 mm. With the nipping width (L) being set in a wide range of from 0.1 to 0.6 mm, the developing roller and the replenishing roller can be produced without maintaining so high precision, and these two rollers can be assembled together without maintaining so high precision, either, making it possible to produce at a lower cost a device for developing electrostatic latent image.

What we claim is:

1. A device for developing an electrostatic latent image comprising a developing housing, a developing roller disposed in said developing housing to hold, on a peripheral surface thereof, a developing agent in a developing agent-holding zone, and convey thus held developing agent to a developing zone to apply it to the electrostatic latent image, and a developing agent-limiting means for limiting an amount of developing agent held on the peripheral surface of said developing roller in a developing agent-limiting zone positioned between the developing agent-holding zone and the developing zone, wherein said developing agent-limiting means includes a flexible blade of which one surface is brought into pressed contact with the peripheral surface of said developing roller, a flexible support plate which is mounted on another surface of said blade and supports said blade maintaining a predetermined positional relationship with respect to said developing roller, and a resilient urging means which is constituted by a plurality of spring members arranged on a back surface of said support plate at a distance in a direction of width thereof and pushes said blade in a direction in which it comes into pressed contact with the peripheral surface of said developing roller via said support plate.

2. A device for developing an electrostatic latent image comprising a developing housing, a developing roller disposed in said developing housing to hold, on a peripheral surface thereof, a developing agent in a developing agent-holding zone and convey thus held developing agent to a developing zone to apply it to the electrostatic latent image, and a developing agent-limiting means for limiting an amount of the developing agent held on the peripheral surface of said developing roller in a developing agent-limiting zone positioned between the developing agent-holding zone and the developing zone, wherein said developing agent-limiting means includes a flexible blade of which one surface is brought into pressed contact with the peripheral surface of said developing roller, a flexible support plate which is mounted on another surface of said blade and supports said blade maintaining a predetermined positional relationship with respect to the developing roller, a flexible pushing member which is disposed by a side of a back surface of said support plate and has a protrusion formed along a direction of width to come into contact with the back surface of said support plate, and a resilient urging means which is constituted by a plurality of spring members arranged on the back surface of said support plate at a distance in the direction of width thereof and pushes said blade in a direction in which it comes into pressed contact with the peripheral surface of said developing roller via said pushing member and said support plate.

3. A device for developing an electrostatic latent image according to claim 2, wherein said developing agent-limiting means includes a support plate which is mounted on another surface of said blade and a support holder for holding said pushing member and said resilient urging means, said support holder comprises an upper wall, a lower wall and a rear wall connecting said upper wall to a rear end of said lower wall, a front surface of said rear wall and an upper surface of said lower wall defining an angle smaller than 90 degrees, and wherein said plurality of spring members constituting said resilient urging means is disposed between the front surface of said rear wall and said pushing member and a front lower edge of said pushing member is brought into contact with the upper surface of said lower wall.

4. A device for developing an electrostatic latent image comprising a developing housing, a developing roller disposed in said developing housing to hold, on a peripheral surface thereof, a developing agent in a developing agent-holding zone and convey thus held developing agent to a developing zone to apply it to the electrostatic latent image, and a developing agent-limiting means for limiting an amount of developing agent held on the peripheral surface of said developing roller in a developing agent-limiting zone positioned between the developing agent-holding zone and the developing zone, wherein said developing agent-limiting means includes a blade made of a flexible sheet glass, of which one surface is brought into pressed contact with the peripheral surface of said developing roller, a flexible support plate which is mounted on another surface of said blade and supports said blade at a predetermined positional relationship with respect to said developing roller, and a resilient urging means which is constituted by a plurality of spring members arranged on a back surface of said support plate at a distance in a direction of width thereof and pushes said blade in a direction in which it comes into pressed contact with the peripheral surface of said developing roller via said support plate, and wherein said blade made of said sheet glass has a thickness of from 0.5 to 2.0 mm.

5. A device for developing an electrostatic latent image comprising a developing housing, a developing roller disposed in said developing housing to hold, on a peripheral surface thereof, a developing agent in a developing agent-holding zone and convey thus held developing agent to a developing zone to apply it to the electrostatic latent image, and a developing agent-limiting means for limiting an amount of developing agent held on the peripheral surface of said developing roller in a developing agent-limiting zone positioned between the developing agent-holding zone and the developing zone, wherein said developing agent-limiting means includes a blade made of a flexible sheet glass, of which one surface is brought into pressed contact with the peripheral surface of said developing roller, a flexible support plate which is mounted on another surface of said blade and supports said blade maintaining a predetermined positional relationship with respect to said developing roller, and a resilient urging means which pushes said blade in a direction in which it comes into pressed contact with the peripheral surface of said developing roller via said support plate, and wherein an amount of projection of said blade from a center of contact with the peripheral surface of said developing roller to a lower end of said blade is set to be from 0.5 to 2.0 mm.

6. A device for developing an electrostatic latent image comprising a developing housing, a developing roller disposed in said developing housing to hold, on a peripheral surface thereof, a developing agent in a developing agent-holding zone and convey thus held developing agent to a developing zone to apply it to the electrostatic latent image, and a developing agent-limiting means for limiting an amount of developing agent held on the peripheral surface of said developing roller in a developing agent-limiting zone positioned between the developing agent-holding zone and the developing zone, wherein said developing agent-limiting means includes a blade made of a flexible sheet glass, of which one surface is brought into pressed contact with the peripheral surface of said developing roller, a flexible support plate which is mounted on another surface of said blade and supports said blade maintaining a predetermined positional relationship with respect to said developing roller, and a resilient urging means which pushes said blade in a direction in which it comes into pressed contact with the peripheral surface of said developing roller via said support plate, and wherein a contacting force of said blade exerted on the peripheral surface of said developing roller by said resilient urging means is from 4.0 to 12.0 g/mm as a line pressure.

7. A device for developing an electrostatic latent image according to claim 6, wherein an amount of projection of said blade from a center of contact with the peripheral surface of said developing roller to a lower end of said blade is set to be from 0.5 to 2.0 mm.

8. A device for developing an electrostatic latent image comprising a developing housing, a developing roller disposed in said developing housing to hold, on a peripheral surface thereof, a developing agent in a developing agent-holding zone and convey thus held developing agent to a developing zone to apply it to the electrostatic latent image, and a developing agent-limiting means for limiting an amount of developing agent held on the peripheral surface of said developing roller in a developing agent-limiting zone positioned between the developing agent-holding zone and the developing zone, wherein a roughness Rz, according to a ten-point average roughness specified under JIS B 0601, of the peripheral surface of said developing roller is set to be from 5.0 to 12.0 $\mu$m.

9. A device for developing an electrostatic latent image comprising a developing housing, a developing roller disposed in said developing housing to hold, on a peripheral surface thereof, a developing agent in a developing agent-holding zone and convey thus held developing agent to a developing zone to apply it to the electrostatic latent image, and a developing agent-limiting means for limiting an amount of the developing agent held on the peripheral surface of said developing roller in a developing agent-limiting zone positioned between the developing agent-holding zone and the developing zone, wherein said developing agent-limiting means includes a blade made of a flexible sheet glass, of which one surface is brought into pressed contact with the peripheral surface of said developing roller, a flexible support plate which is mounted on another surface of said blade and supports said blade maintaining a predetermined positional relationship with respect to said developing roller, and a resilient urging means which pushes said blade in a direction in which it comes into pressed contact with the peripheral surface of said developing roller via the support plate, and wherein said developing roller is constituted by a rotary shaft formed of a metal material and a solid synthetic rubber roller fitted onto the rotary shaft, and said developing roller has an Asker's C hardness of from 60 to 80.

10. A device for developing an electrostatic latent image according to claim 9, wherein a contacting force of said blade exerted on the peripheral surface of said developing roller by said resilient urging means is set to be from 4.0 to 12.0 g/mm as a line pressure.

11. A device for developing an electrostatic latent image comprising a developing housing, a developing roller disposed in said developing housing to hold, on a peripheral surface thereof, a developing agent in a developing agent-holding zone and convey thus held developing agent to a developing zone to apply it to the electrostatic latent image, a replenishing roller which is disposed in parallel with said developing roller and feeds the developing agent onto the peripheral surface of said developing roller in the developing agent-holding zone, and a developing agent-limiting means for limiting an amount of developing agent held on the peripheral surface of said developing roller in a developing agent-limiting zone positioned between the developing agent-holding zone and the developing zone, wherein said developing agent-limiting means includes a flexible blade having a thickness of from 0.1 to 2.0 mm, of which one surface is brought into pressed contact with the peripheral surface of said developing roller, a flexible support plate which is mounted on another surface of said blade and supports said blade maintaining a predetermined positional relationship with respect to said developing roller, and a resilient urging means which pushes said blade in a direction in which it comes into pressed contact with the peripheral surface of said developing roller via said support plate, and wherein a nipping width in which said developing roller and said replenishing roller come into contact with each other is set to be from 0.1 to 0.6 mm.

12. A device for developing an electrostatic latent image according to claim 11, wherein said blade is constituted by a sheet glass having a thickness of from 0.5 to 2.0 mm.

* * * * *